US010192695B2

(12) United States Patent
Sheng

(10) Patent No.: US 10,192,695 B2
(45) Date of Patent: Jan. 29, 2019

(54) KEYSWITCH ASSEMBLY AND MANUFACTURING METHOD THEREOF

(71) Applicant: GETAC TECHNOLOGY CORPORATION, Hsinchu (TW)

(72) Inventor: Yen-Long Sheng, Taipei (TW)

(73) Assignee: GETAC TECHNOLOGY CORPORATION, Hsinchu County (TW)

( * ) Notice: Subject to any disclaimer, the term of this patent is extended or adjusted under 35 U.S.C. 154(b) by 0 days.

(21) Appl. No.: 15/246,242

(22) Filed: Aug. 24, 2016

(65) Prior Publication Data

US 2018/0061594 A1 Mar. 1, 2018

(51) Int. Cl.

| | |
|---|---|
| ***H01H 9/00*** | (2006.01) |
| ***H01H 13/02*** | (2006.01) |
| ***H01H 13/10*** | (2006.01) |
| *H01H 11/00* | (2006.01) |

(52) U.S. Cl.

CPC ..... *H01H 13/023* (2013.01); *H01H 13/10* (2013.01); *H01H 11/00* (2013.01); *H01H 2219/002* (2013.01); *H01H 2219/054* (2013.01)

(58) Field of Classification Search

CPC ..... H01H 13/023; H01H 13/10; H01H 11/00; H01H 2219/002; H01H 2219/054; H01H 3/00; H01H 3/12; H01H 13/00; H01H 13/02; H01H 13/14; H01H 13/50; H01H 13/52; H01H 13/70; H01H 13/7006; H01H 13/702; H01H 2003/12; H01H 2009/16; H01H 2009/161; H01H 2009/18; H01H 2009/182; H01H 2009/183; H01H 2009/186; H01H 2009/187; H01H 2219/036; H01H 2219/039; H01H 2219/04; H01H 2219/044; H01H 2219/048; H01H 2219/062; H01H 2219/0621; H01H 2219/066; H01H 2221/00

USPC ..... 200/314

See application file for complete search history.

(56) References Cited

U.S. PATENT DOCUMENTS

| | | | | |
|---|---|---|---|---|
| 6,936,783 | B2 * | 8/2005 | Kawaguchi | H01H 9/182 200/314 |
| 8,134,094 | B2 * | 3/2012 | Tsao | H01H 13/705 200/345 |
| 2002/0021562 | A1 | 2/2002 | Tholin et al. | |

(Continued)

FOREIGN PATENT DOCUMENTS

| | | | |
|---|---|---|---|
| CN | 1738328 | A | 2/2006 |
| CN | 101189569 | A | 5/2008 |
| JP | S60 148017 | A | 8/1985 |

(Continued)

*Primary Examiner* — Anthony R. Jimenez

(57) ABSTRACT

A keyswitch assembly and a manufacturing method thereof are disclosed. The keyswitch assembly includes a display unit, a carrier, one or more contact pads, a light-shielding layer, and a transparent keycap. The display unit includes one or more display regions. The carrier is for carrying the display unit. The contact pads are on the carrier and are electrically connected to the display regions. The light-shielding layer is positioned corresponding to the display regions. The light-shielding layer includes one or more transparent patterns. The transparent patterns are positioned respectively corresponding to the display regions. The transparent keycap is positioned on the display unit.

19 Claims, 10 Drawing Sheets

(56) References Cited

U.S. PATENT DOCUMENTS

2015/0248173 A1* 9/2015 Hinz ..... G02F 1/1396
349/1

FOREIGN PATENT DOCUMENTS

JP 2003016866 A * 1/2003
WO WO 2010/140573 A1 12/2010

* cited by examiner

KEYSWITCH ASSEMBLY AND MANUFACTURING METHOD THEREOF

BACKGROUND OF THE INVENTION

Field of the Invention

The present invention relates to a structure of a keyboard and, more particularly, to a keyswitch assembly and a manufacturing method thereof.

Description of the Prior Art

Inputting devices of computer peripheral equipment generally include keyboards, mice, and trackballs. Keyboards get much attention from users and manufactures since words, symbols, or numbers can be directly inputted to computers by keyboards. Over the last few years, keyboards were kept being developed to meet more powerful inputting function and to have an additional function with respect to visual effects. Therefore, keyboards capable of emitting light during operation are the trend of development nowadays.

Conventionally, a keyboard includes multiple keys. Each key may have multiple patterns on it, and each pattern is corresponding to a particular function. According to the patterns on each of the keys, a user can recognize what functions a key is corresponding to. One of the functions corresponding to one of the keys can be executed by being switched.

A conventional lightening keyboard can emit light during operation; however, each of the keys has only two modes of lightening, all patterns on one key being bright or being dark. That is to say, the patterns on one key have to be switched to a light-on state or a light-off state in a group way, and consequently the patterns on one key are incapable of being individually bright or dark to meet different scenarios.

SUMMARY OF THE INVENTION

The present invention provides a keyswitch assembly and a manufacturing method thereof. Multiple patterns on one of keys of a keyboard can be individually controlled to be bright or to be dark.

According to an embodiment, a keyswitch assembly comprises a display unit, a carrier, a plurality of contact pads, a light-shielding layer, and a transparent keycap. The display unit comprises a plurality of display regions. The carrier is for carrying the display unit. The contact pads are on the carrier and are electrically connected to the display regions. The light-shielding layer is positioned corresponding to the display regions of the display unit. The light-shielding layer comprises a plurality of transparent patterns. The transparent patterns are positioned respectively corresponding to the display regions of the display unit. The transparent keycap is positioned on the display unit.

According to an embodiment, a manufacturing method of a keyswitch assembly comprises: forming a plurality of contact pads on a carrier; positioning a display unit on the carrier; forming a light-shielding layer comprising a plurality of transparent patterns corresponding to a plurality of display regions of the display unit; and positioning a transparent keycap on the display unit. Wherein, the display regions of the display unit are electrically connected to the contact pads. The transparent patterns of the light-shielding layer are respectively corresponding to the display regions of the display unit.

Concisely, according to embodiments of the keyswitch assembly and the manufacturing method thereof of the present invention, each of the patterns on one key can be individually bright or dark to meet different scenarios by individually controlling the display regions corresponding to each of the transparent patterns.

The features of the present invention will no doubt become understandable to those of ordinary skill in the art after reading the following detailed description of the preferred embodiment that is illustrated in the various figures and drawings.

DETAILED DESCRIPTION OF THE EMBODIMENTS

Figure 1:
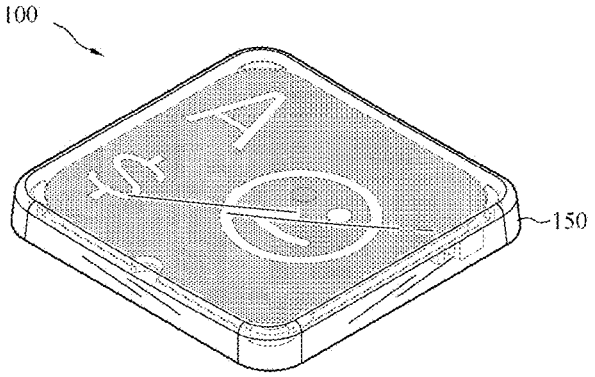
FIG. 1 illustrates a perspective view of a keyswitch assembly according to the first embodiment of the present invention.
Figure 2:
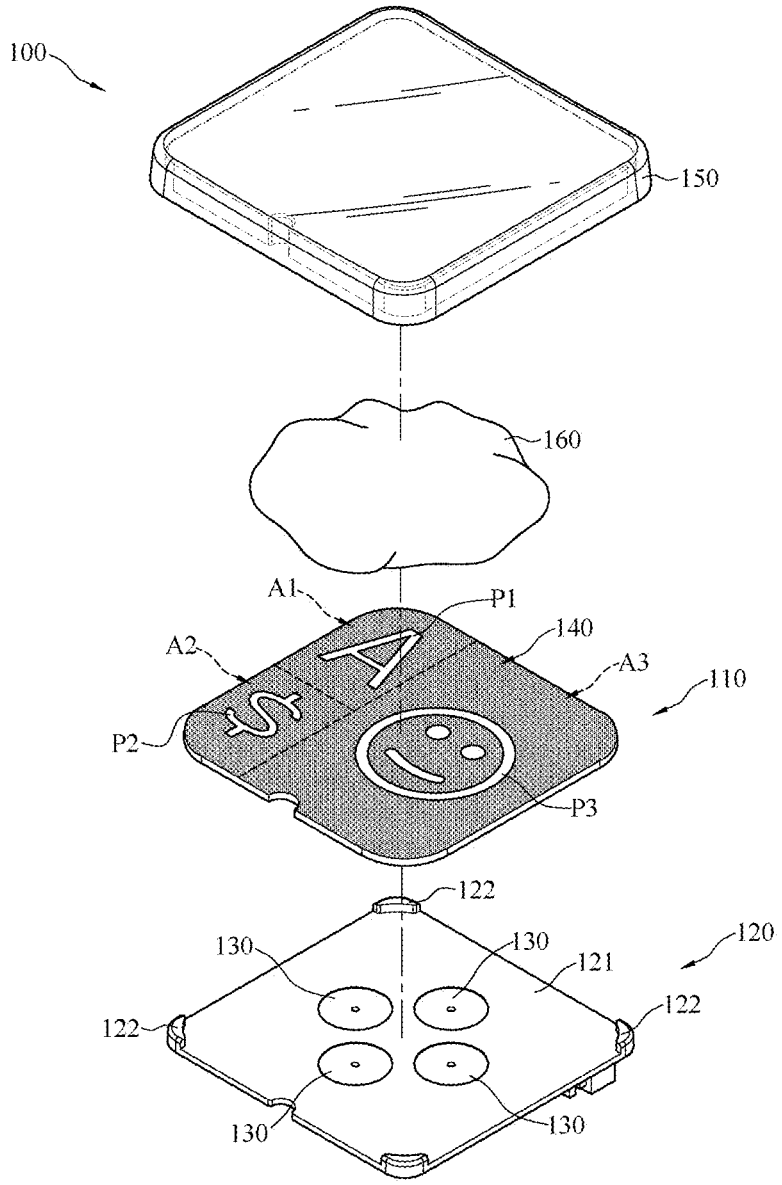
FIG. 2 illustrates an exploded view of the keyswitch assembly in a viewing angle of depression according to the first embodiment of the present invention.
Figure 3:
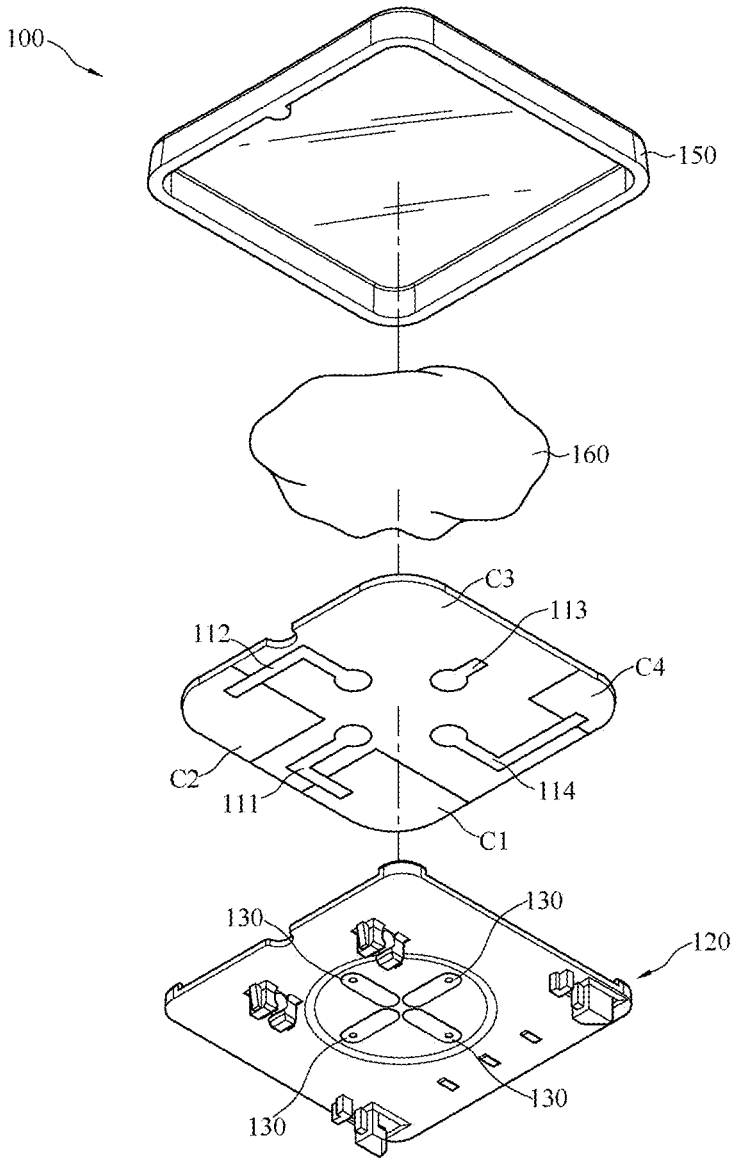
FIG. 3 illustrates an exploded view of the keyswitch assembly in a viewing angle of elevation according to the first embodiment of the present invention.
Figure 4:
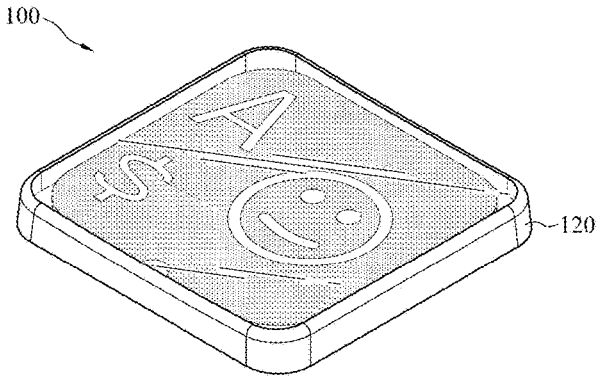
FIG. 4 illustrates a perspective view of a practical aspect of the keyswitch assembly according to the first embodiment of the present invention.
Figure 5:
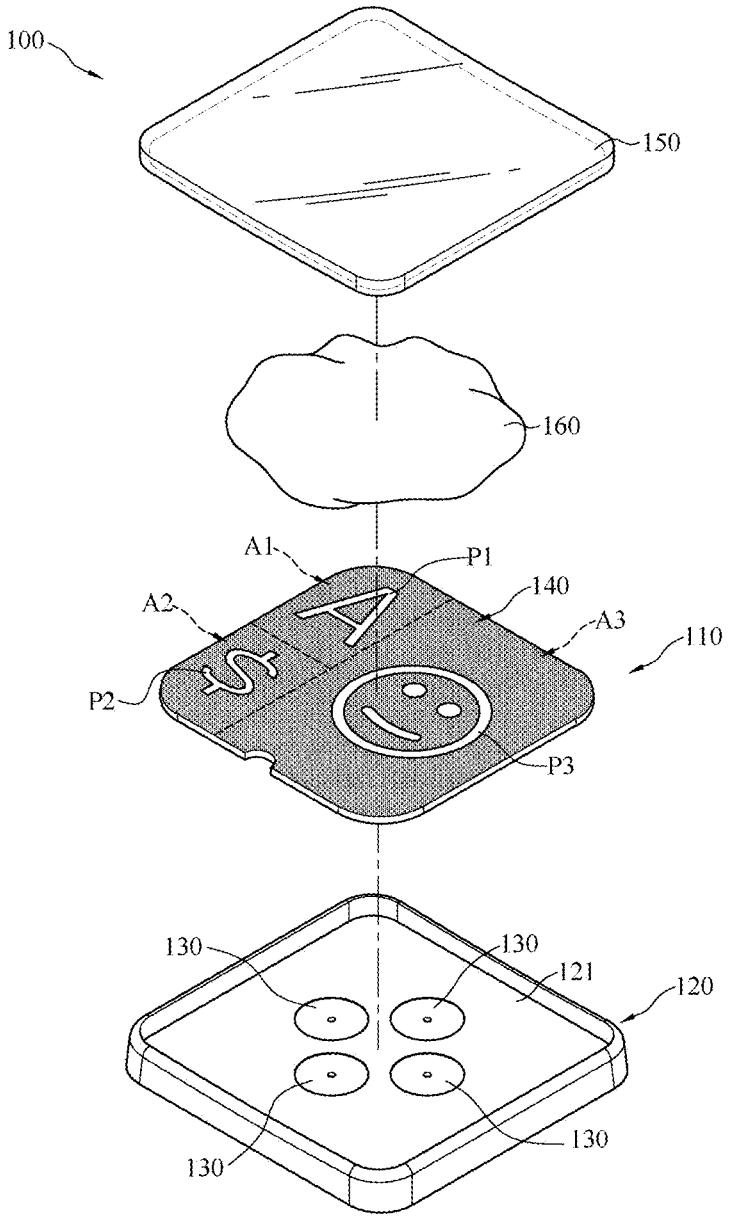
FIG. 5 illustrates an exploded view of a practical aspect of the keyswitch assembly in a viewing angle of depression according to the first embodiment of the present invention.
Figure 6:
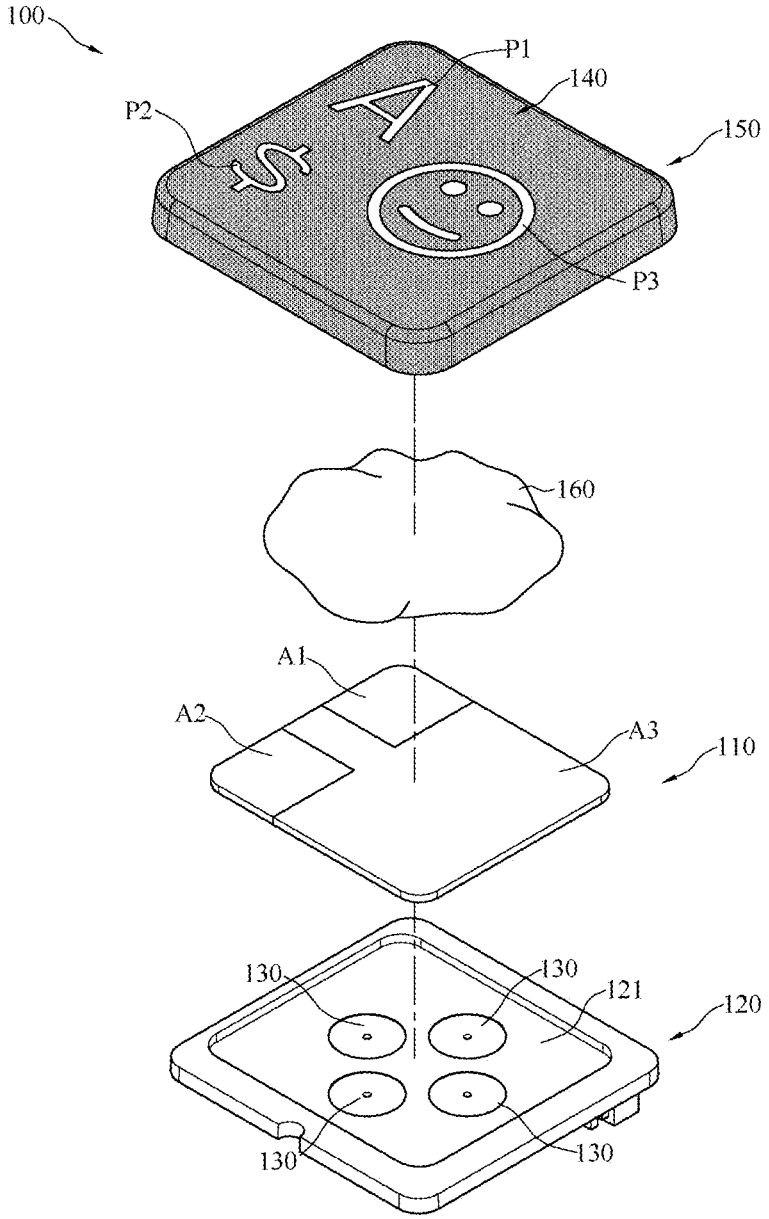
FIG. 6 illustrates an exploded view of a keyswitch assembly in a viewing angle of depression according to the second embodiment of the present invention.

FIG. 1 is a perspective view of a keyswitch assembly according to the first embodiment of the present invention. FIG. 2 is an exploded view of the keyswitch assembly in a viewing angle of depression according to the first embodiment of the present invention. FIG. 3 is an exploded view of the keyswitch assembly in a viewing angle of elevation according to the first embodiment of the present invention. FIG. 4 is a perspective view of a practical aspect of the keyswitch assembly according to the first embodiment of the present invention. FIG. 5 is an exploded view of a practical aspect of the keyswitch assembly in a viewing angle of depression according to the first embodiment of the present invention. FIG. 6 is an exploded view of a keyswitch assembly in a viewing angle of depression according to the second embodiment of the present invention.

Please refer to FIG. 1 to FIG. 6. A keyswitch assembly 100 comprises a display unit 110, a carrier 120, a plurality of contact pads 130, a light-shielding layer 140, and a transparent keycap 150.

The carrier 120 comprises a first surface and a second surface opposite to the first surface. The carrier 120 comprises a carrying portion 121 formed on the first surface of the carrier 120. In the embodiment, the carrying portion 121 is for receiving the display unit 110, by which the display unit 110 is able to be coupled to the carrier 120 without being loose. In an embodiment, as shown in FIG. 5 and FIG. 6, the carrying portion 121 can be a recess of the first surface of the carrier 120. In another embodiment, as shown in FIG. 2, the carrying portion 121 can be a receiving space between a plurality of blocking components (or coupling components) 122. Wherein, the blocking components (or coupling components) 122 are diagonally arranged on the first surface of a bottom plate of the carrier 120. In some embodiments, the carrier 120 can be, but is not limited to, a one piece plastic component. In some embodiments, the carrier 120 can be substantially a rectangular plate.

The display unit 110 comprises a plurality of display regions. Each of the display regions can be individually switched to a light-on state (being bright) or a light-off state (being dark) in response to a corresponding control signal. Hereinafter three display regions A1-A3 are illustrated; however, the present invention is not limited to the illustration, and the number of the display regions of the display unit depends on needs.

In some embodiments, the area for displaying of the display region A1 is, but is not limited to, substantially equal to that of the display region A2. The area for displaying of the display region A3 is, but is not limited to, substantially greater than that of the display region A1.

In some embodiments, the display unit 110 comprises a display surface and a setting surface opposite to the display surface. The display surface is for displaying patterns, and the setting surface is for arranging a control region and/or a connecting electrode. In the embodiment, there are four control regions C1-C4 being arranged on the setting surface corresponding to the arrangement of the display regions A1-A3. Nevertheless, the number of the control region(s) is not limited to four.

The control regions C1-C4 can receive the control signals and individually operate in response to corresponding control signals. In some embodiments, the control regions C1-C3 can receive a first control signal, and the control region C4 can receive a second control signal. Wherein, the electrical properties of the first control signal and the second control signal are opposite to each other. For example, the second control signal is electronegative while the first control signal is electropositive.

The control region C1 is positioned corresponding to the display region A1. The control region C2 is positioned corresponding to the display region A2. The control region C3 is positioned corresponding to the display region A3. The control region C4 can be positioned anywhere. For example, the control region C4 can be positioned corresponding to the display region A3 which has the largest area for displaying. In the embodiment, the control regions C1-C4 are not electrically connected to one another.

Figure 7:
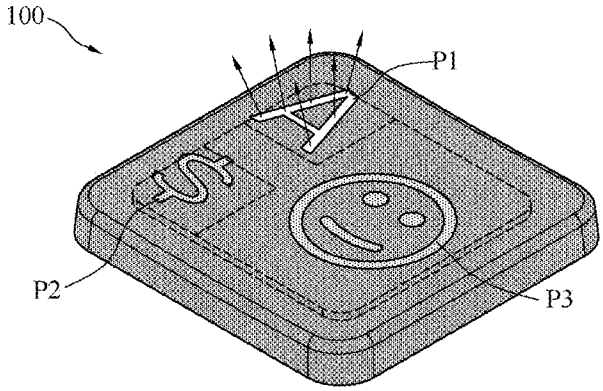
FIG. 7 illustrates a perspective view of a keyswitch assembly being bright according to an embodiment of the present invention.
Figure 8:
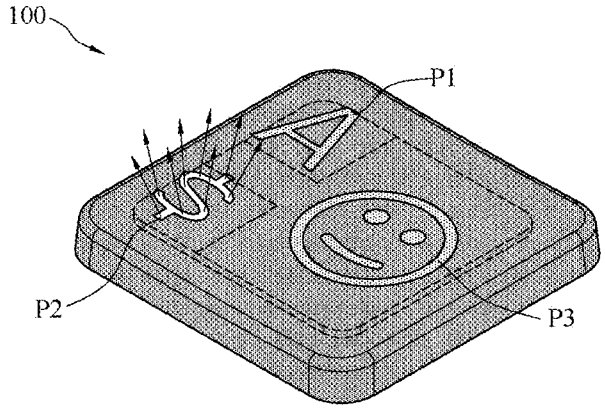
FIG. 8 illustrates a perspective view of a keyswitch assembly being bright according to an embodiment of the present invention.
Figure 9:
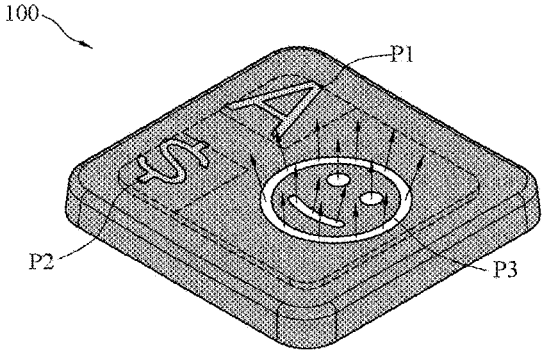
FIG. 9 illustrates a perspective view of a keyswitch assembly being bright according to an embodiment of the present invention.

In some embodiments, each of the display regions A1-A3 is controlled by the corresponding first control signal and the shared second control signal. For example, when the control region C1 receives the first control signal, and the control region C4 receives the second control signal, the display region A1 displays the pattern (or the pattern of the display region A1 is bright), as shown in FIG. 7. When the control region C2 receives the first control signal, and the control region C4 receives the second control signal, the display region A2 displays the pattern (or the pattern of the display region A2 is bright), as shown in FIG. 8. Further, when the control region C3 receives the first control signal, and the control region C4 receives the second control signal, the display region A3 displays the pattern (or the pattern of the display region A3 is bright), as shown in FIG. 9.

The display unit 110 further comprises a plurality of connecting electrodes. The connecting electrodes are on the setting surface of the display unit 110. Hereinafter four connecting electrodes 111-114 corresponding to the control regions C1-C4 are illustrated; however, the present invention is not limited to the illustration. In an embodiment, the connecting electrode 111 is electrically connected to the control region C1 and drives the control region C1 in response to the first control signal. The connecting electrode 112 is electrically connected to the control region C2 and drives the control region C2 in response to the first control signal. The connecting electrode 113 is electrically connected to the control region C3 and drives the control region C3 in response to the first control signal. The connecting electrode 114 is electrically connected to the control region C4 and drives the control region C4 in response to the second control signal.

The contact pads 130 are on the carrier 120. The contact pads are for receiving the first control signal and the second control signal. Each of the contact pads 130 is positioned on the carrying portion 121 of the carrier 120 corresponding to the positions of the connecting electrodes 111-114, by which when the display unit 110 is installed on the carrying portion 121, each of the contact pads 130 can be electrically connected to the control regions C1-C4 by the corresponding connecting electrodes 111-114, and the display regions A1-A3 can operate according to the control regions C1-C4 being driven.

In some embodiments, the contact pads 130 can be metallic films attached to the carrier 120.

In addition, the contact pads 130 are not only positioned on the first surface of the carrier 120 but also extend to the second surface of the carrier 120, by which both of two opposite sides of the carrier 120 can be electrically connected to other components by the contact pads 130.

The light-shielding layer 140 is for shielding light to prevent light from passing through it. The light-shielding layer 140 comprises a plurality of transparent patterns. The transparent patterns are positioned respectively corresponding to the display regions A1-A3 of the display unit 110. Hereinafter three transparent patterns P1-P3 are illustrated; however, the present invention is not limited to the illustration. That is to say, the number of the transparent patterns can be greater than that of the display regions, and multiple transparent patterns can be positioned corresponding to one display region. For example, when two transparent patterns are corresponding to one display region, the two transparent patterns can be bright or dark in the same time corresponding to whether the display region is switched to the light-on state or the light-off state.

The transparent pattern P1 is positioned corresponding to the display region A1 so as to be bright or dark corresponding to the state of the display region A1. The transparent pattern P2 is positioned corresponding to the display region A2 so as to be bright or dark corresponding to the state of the display region A2. The transparent pattern P3 is positioned corresponding to the display region A3 so as to be bright or dark corresponding to the state of the display region A3. In other words, the state of each of the transparent patterns P1-P3 with respect to being bright or dark can be controlled by the corresponding display regions A1-A3 being switched to the light-on state or the light-off state.

In the embodiment, each of the transparent patterns P1-P3 can be a through hole on the light-shielding layer 140 so as to expose a part of the corresponding display regions A1-A3, by which light emitted from the display regions A1-A3 can pass through the transparent patterns P1-P3. As a result, each of the transparent patterns P1-P3 is capable of being bright.

In some embodiments, the light-shielding layer 140 can be a coating material with colors or with a single color and can be formed by a spray process. In addition, the light-shielding layer 140 can be, but not limited to, a structure with a single layer. To meet a better effect of light shielding, the light-shielding layer 140 can also be a structure with multiple layers. The transparent patterns P1-P3 of the light-shielding layer 140 can be formed in a laser-carving manner, which results in predetermined positions of the light-shielding layer 140 being hollowed out. In some embodiments, the transparent patterns P1-P3 can be words, symbols, letters, or numbers.

In addition to the display regions A1-A3 of the display unit 110 being able to be bright or dark in a group way, the display regions A1-A3 are also able to display one or more predetermined, particular patterns, which is one of the features of the embodiments (the part of the particular pattern(s) is bright while the other part of other pattern(s) is dark). Particular patterns displayed by each of the display regions A1-A3 are corresponding to the transparent patterns P1-P3 of the light-shielding layer 140. In other words, each of the transparent patterns P1-P3 can expose the particular patterns displayed by each of the display regions A1-A3, such that each of the transparent patterns P1-P3 can be bright or dark.

In some embodiments, the display unit 110 can be, but not limited to, an LED display, an OLED display, or an electronic paper.

In an embodiment, the light-shielding layer 140 can be directly positioned on the display unit 110, as shown in FIG. 2 and FIG. 5. In another embodiment, the light-shielding layer 140 can be positioned on the transparent keycap 150, as shown in FIG. 6 to FIG. 9.

The transparent keycap 150 can be positioned on the carrier 120 and can protect the display unit 110 to prevent steam or dust from damaging the display unit 110 and also prevent users from scratching the display surface of the display unit 110. In some embodiments, the transparent keycap 150 can be a transparent plastic housing made by, for example, polycarbonate (PC).

In an embodiment, as shown in FIG. 2 and FIG. 6, the transparent keycap 150 is a cap. The size of an opening of the transparent keycap 150 is slightly greater than that of the carrier 120, such that the transparent keycap 150 is, but is not limited to, combined with the carrier 120 by receiving the carrier 120, as shown in FIG. 1 and FIG. 7. In another embodiment, as shown in FIG. 5, the transparent keycap 150 is a plate. The size of transparent keycap 150 is substantially equal to that of an opening of the carrying portion 121 of the carrier 120, such that the transparent keycap 150 along with the display unit 110 can be coupled in the opening of the carrying portion 121, as shown in FIG. 4.

The keyswitch assembly 100 further comprises a medium layer 160. The medium layer 160 is positioned between the transparent keycap 150 and the display unit 110. The medium layer 160 is beneficial of light guiding and/or can be an adhesive medium between the transparent keycap 150, the display unit 110, and the carrier 120. In some embodiments, the medium layer 160 can be an ultraviolet-curing adhesive (UV-curing adhesive).

Figure 10:
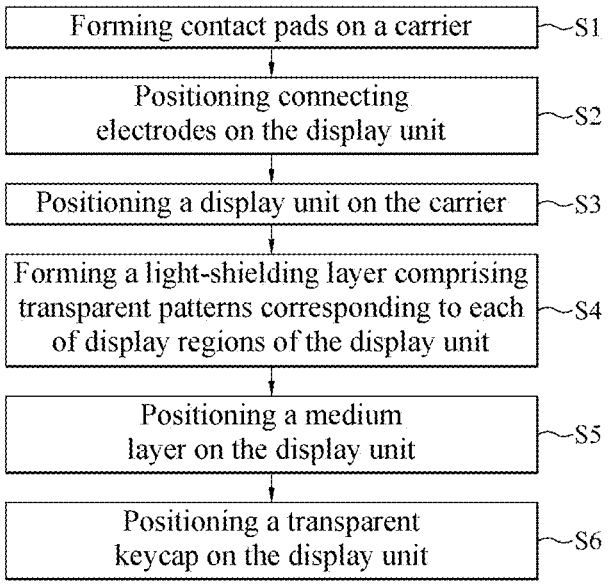
FIG. 10 illustrates a flow chart of a manufacturing method of a keyswitch assembly according to an embodiment of the present invention.

FIG. 10 is a flow chart of a manufacturing method of a keyswitch assembly according to an embodiment of the present invention. Please refer to FIG. 10. The manufacturing method of the keyswitch assembly 100 comprises: forming a plurality of contact pads 130 on a carrier 120 (step S1); positioning a display unit 110 on the carrier 120 (step S3); forming a light-shielding layer 140 comprising a plurality of transparent patterns P1-P3 corresponding to a plurality of display regions A1-A3 of the display unit 110 (step S4); and positioning a transparent keycap 150 on the display unit 110 (step S6).

In some embodiments, the manufacturing method of the keyswitch assembly 100 further comprises positioning a plurality of connecting electrodes 111-114 on the display unit 110 (step S2). In addition, the sequence of the steps S1 and S2 can be reversed. That is to say, the connecting electrodes 111-114 are positioned on the setting surface corresponding to the driving mechanism of the display unit 110 in advance, and then the contact pads 130 are positioned on the carrying portion 121 of the carrier 120 corresponding to the positions of the connecting electrodes 111-114. When the step S3 is done, each of the connecting electrodes 111-114 of the display unit 110 can contact each of the corresponding contact pads 130.

Figure 11:
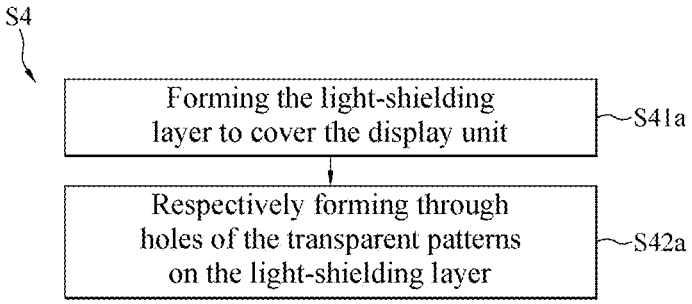
FIG. 11 illustrates a flow chart of step S4 of FIG. 10 according to an embodiment of the present invention.

FIG. 11 is a flow chart of the step S4 of FIG. 10 according to an embodiment of the present invention. Please refer to FIG. 10 and FIG. 11. According to an embodiment of the step S4, the step S4 can comprises forming the light-shielding layer 140 to cover the display unit 110 (step S41*a*) and respectively forming a plurality of through holes of the transparent patterns P1-P3 on the light-shielding layer 140 (step S42*a*). In other words, under the circumstance, the light-shielding layer 140 is directly formed on the display surface of the display unit 110 and fully covers the display surface of the display unit 110. Next is to form a plurality of through holes on the light-shielding layer 140 corresponding to the positions of each of the display regions A1-A3 of the display unit 110 so as to expose a part of the display regions A1-A3. The exposed part of each of the display regions A1-A3 forms the transparent patterns P1-P3, as shown in FIG. 2 and FIG. 5.

Figure 12:
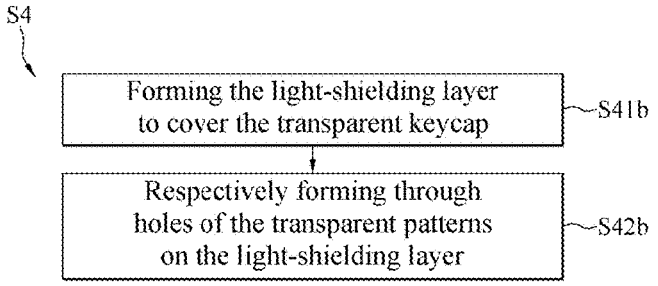
FIG. 12 illustrates a flow chart of step S4 of FIG. 10 according to another embodiment of the present invention.

FIG. 12 is a flow chart of the step S4 of FIG. 10 according to another embodiment of the present invention. Please refer to FIG. 10 and FIG. 12. According to another embodiment of the step S4, the step S4 can comprises forming the light-shielding layer 140 to cover the transparent keycap 150 (step S41*b*) and respectively forming a plurality of through holes of the transparent patterns P1-P3 on the light-shielding layer 140 (step S42*b*). In other words, under the circumstance, the light-shielding layer 140 is formed on the transparent keycap 150 and fully covers the transparent keycap 150. Next is to form a plurality of through holes on the light-shielding layer 140 corresponding to the positions of each of the display regions A1-A3 of the display unit 110 so as to expose a part of the transparent keycap 150. The exposed part of the transparent keycap 150 forms the transparent patterns P1-P3, as shown in FIG. 6.

Please refer to FIG. 10. In some embodiments, before the step S6, the manufacturing method of the keyswitch assembly 100 further comprises positioning a medium layer 160 on the display unit 110 (step S5) so as to have the medium layer 160 positioned between the transparent keycap 150 and the display unit 110. In the embodiment, the medium layer 160 is beneficial of light guiding and/or can be an adhesive medium between the transparent keycap 150 and the display unit 110.

Concisely, according to embodiments of the keyswitch assembly and the manufacturing method thereof of the present invention, each of the patterns on one key can be individually bright or dark to meet different scenarios by individually controlling the display regions corresponding to each of the transparent patterns.

While the present invention has been described by way of example and in terms of the preferred embodiments, it is to be understood that the present invention needs not be limited to the disclosed embodiments. For anyone skilled in the art, various modifications and improvements within the spirit of the present invention are covered under the scope of the present invention. The covered scope of the present invention is based on the appended claims.

What is claimed is:

1. A keyswitch assembly corresponding to a single key on a keyboard, comprising:

a display unit comprising a plurality of display regions each capable of being individually switched between a light-on and a light-off state;

a carrier for carrying the display unit;

a plurality of contact pads on the carrier, the contact pads being electrically connected to the display regions;

a light-shielding layer positioned corresponding to the display regions, the light-shielding layer comprising a plurality of transparent patterns, the transparent patterns positioned respectively corresponding to the display regions; and a transparent keycap positioned on the display unit;

wherein the light-shielding layer comprises a layer of light-shielding material in which the transparent patterns are formed, wherein the transparent patterns permit light emitted from the corresponding display regions to pass through.

2. The keyswitch assembly of claim 1, further comprising:

a medium layer positioned between the transparent keycap and the display unit.

3. The keyswitch assembly of claim 1, wherein the light-shielding layer is positioned on the display unit.

4. The keyswitch assembly of claim 1, wherein the light-shielding layer is positioned on the transparent keycap.

5. The keyswitch assembly of claim 1, wherein each of the display regions generates light individually in response to a control signal received from the corresponding contact pad.

6. The keyswitch assembly of claim 1, wherein the display unit further comprises a plurality of connecting electrodes, the connecting electrodes are positioned respectively corresponding to the display regions, and the connecting electrodes respectively contacts the contact pads.

7. The keyswitch assembly of claim 1, wherein each of the transparent patterns is a through hole on the light-shielding layer.

8. The keyswitch assembly of claim 1, wherein the transparent keycap covers the entire display unit.

9. A manufacturing method of a keyswitch assembly corresponding to a single key on a keyboard, comprising:

forming a plurality of contact pads on a carrier;

positioning a display unit on the carrier, wherein the display unit comprises a plurality of display regions each capable of being individually switched between a light-on and a light-off state, and the display regions are electrically connected to the contact pads;

forming a light-shielding layer comprising a plurality of transparent patterns corresponding to the display regions, wherein the transparent patterns are respectively corresponding to the display regions; and positioning a transparent keycap on the display unit;

wherein the light-shielding layer comprises a layer of light-shielding material in which the transparent patterns are formed, wherein the transparent patterns permit light emitted from the corresponding display regions to pass through.

10. The manufacturing method of a keyswitch assembly of claim 9, further comprising:

positioning a medium layer between the transparent keycap and the display unit.

11. The manufacturing method of a keyswitch assembly of claim 9, further comprising:

positioning a plurality of connecting electrodes on the display unit corresponding to the display regions to have the connecting electrodes respectively contact the contact pads.

12. The manufacturing method of a keyswitch assembly of claim 9, wherein the step of forming a light-shielding layer comprising a plurality of transparent patterns corresponding to the display regions comprises:

forming the light-shielding layer to cover the display unit; and respectively forming a plurality of through holes of the transparent patterns on the light-shielding layer.

13. The manufacturing method of a keyswitch assembly of claim 9, wherein the step of forming a light-shielding layer comprising a plurality of transparent patterns corresponding to the display regions comprises:

forming the light-shielding layer to cover the transparent keycap; and respectively forming a plurality of through holes of the transparent patterns on the light-shielding layer.

14. The manufacturing method of a keyswitch assembly of claim 9, wherein the transparent keycap covers the entire display unit.

15. A keyswitch assembly corresponding to a single key on a keyboard, comprising:

a display unit comprising a display surface and a setting surface, wherein a plurality of display regions are arranged on the display surface, and a plurality of control regions corresponding respectively to the display regions are disposed on the setting surface;

a carrier supporting the display unit, wherein the carrier comprises a first surface, a second surface opposite to the first surface and a plurality of contact pads arranged on the first surface and extending to the second surface, the contact pads each respectively electrically connected to a corresponding one of the control regions.

16. The keyswitch assembly of claim 15, wherein the display unit further comprises a plurality of contacting electrodes disposed on the setting surface, each contacting electrode electrically connected between corresponding ones of the control regions and the contact pads.

17. The keyswitch assembly of claim 15, further comprising a transparent keycap positioned on the display unit.

18. The keyswitch assembly of claim 15, further comprising a light-shielding layer positioned corresponding to the display regions, the light-shielding layer comprising a plurality of transparent patterns, the transparent patterns each positioned respectively corresponding to one of the display regions.

19. The keyswitch assembly of claim 18, wherein the light-shielding layer is positioned on the display surface or a transparent keycap positioned on the display unit.

* * * * *